United States Patent [19]

Bois

[11] Patent Number: 4,781,384

[45] Date of Patent: Nov. 1, 1988

[54] STORAGE BOX

[76] Inventor: Rene Bois, "Bois du Roch", St-Genest-De-Contest 81440, Lautrec, France

[21] Appl. No.: 913,847

[22] Filed: Sep. 30, 1986

[30] Foreign Application Priority Data

Sep. 30, 1986 [FR] France ..... 85 15045

[51] Int. Cl.[4] ..... A63F 3/00; A45C 13/10; B65D 85/20; B65D 73/00

[52] U.S. Cl. ..... 273/285; 273/284; 206/472; 206/315.1; 206/1.5

[58] Field of Search ..... 273/285, 287; D21/15, D21/16; 206/472, 315.1, 1.5; 220/345

[56] References Cited

U.S. PATENT DOCUMENTS

| | | | |
|---|---|---|---|
| 343,496 | 6/1886 | Seliger | 273/285 |
| 393,432 | 11/1888 | Hebbard | 206/472 |
| 445,002 | 1/1891 | Grohbrugge | 206/1.5 |
| 644,623 | 3/1900 | Mueller | 206/315.1 |
| 673,083 | 4/1901 | Mato | 206/1.5 |
| 1,233,605 | 7/1917 | Ridley | 206/1.5 |

FOREIGN PATENT DOCUMENTS

| | | | |
|---|---|---|---|
| 124581 | 9/1931 | Austria | 206/1.5 |
| 456883 | 3/1928 | Fed. Rep. of Germany | 273/285 |
| 699473 | 11/1940 | Fed. Rep. of Germany | 273/285 |
| 559597 | 9/1942 | Fed. Rep. of Germany | 273/285 |
| 31082 | 7/1984 | Fed. Rep. of Germany | 273/285 |
| 1143908 | 10/1957 | France | 273/285 |
| 2383583 | 6/1978 | France | 273/285 |
| 1163871 | 6/1985 | U.S.S.R. | 273/260 |
| 1436453 | 6/1973 | United Kingdom | 273/285 |

*Primary Examiner*—Richard C. Pinkham
*Assistant Examiner*—Benjamin Layno
*Attorney, Agent, or Firm*—Spencer & Frank

[57] ABSTRACT

A box for storing social games having the form of a book and comprising two symmetrical parts forming the covers of the book which are articulatedly mounted on one another by hinges. The box is movable between a closed position and an open position. When the box is in the open position, the symmetrical parts are positioned one adjacent the other on one plane so that game pieces can be placed thereon. When the box is in the closed position, each symmetrical part is pressed against the other and a male component is provided having a salient portion which forms the back of the book. The two symmetrical parts forming the covers of the book form a female component of the book which is further provided on the side of the hinges within an aperture into which the salient portion of the male component can be inserted to secure the box in the closed position.

17 Claims, 3 Drawing Sheets

STORAGE BOX

BACKGROUND OF THE INVENTION

1. Field of the Invention

The present invention relates to social games such as the games of checkers, chess, the game of goose or other games of the snakes and ladders type. The present invention is more particularly concerned with a storage box containing the pieces (cards, pawns, dice, and the like) and the boards (circuits, checkerboards and the like) for one or more of the above games.

2. Description of the Background

A storage box for a social game is generally composed of two symmetrical parts articulated to one another on one side of the box. This results in the two parts being placed one against the other when the box enclosing the game pieces therein is in the closed position, and the two parts of the box being layered out in the same plane and one placed as a prolongation of the other when the box is in the open position or playing position. When the box is in the open position, it provides a planar surface on which the game pieces can be placed.

This classical conception of a box for social games opened the horizon for the creation of a number of other box models aimed in particular to modifying the structure of the latter as a function of the nature of the games which they contain.

Thus, for example, the box for card games disclosed and represented by French Pat. No. 1,338,492, comprises a bottom pierced with holes centered over each card game. These holes permit the passage of a finger to extract the games from the box.

Another box, described and represented in the French Patent Applications Nos. 1,384,773 and 2,383,583, has the interior face of two symmetrical parts thereof covered with a magnetic metal. Thus, the game pieces can be magnetically maintained over said interior face.

Another box, which is the object of French Pat. No. 2,258,880 comports a detachable and reversible sliding rectangular plate on top of the external face of each of the two articulated symmetrical parts thereof. Each face of the two articulated symmetrical parts forms one half of the game in a manner such that in the open position or playing position the inside of the box offers a choice between two games whose boards are displayed on the visible face of the two sliding plaques. The two sliding plaques become adjacent for forming the entire gameboard.

Other prior improvements provided over the basic box for social games have adopted the general form of a book for easy storage between other books in a bookcase also permitting the discrete transportation of the game during the course of a trip.

Such book-boxes were described and represented in the German Pat. Nos. 31,082; 456,883 and in the British Pat. Nos. 559,597 and 1,436,453.

In view of the aforegoing, the present invention provides herein a novel conception of a book-box capable of offering a balanced equilibrium between the esthetic contribution of a book and the functional contribution of a box.

To this effect, the box of the invention for the storage of social games, adopts the general form of a book. A remarkable feature of the invention is that this said box is composed of one male and one female disociable components.

The male component is constituted by a salient portion forming the back of the book, and the female component is constituted by the two articulated symmetrical parts which form the box, and which delimit an aperture on the side of the articulation of said box in its closed position.

When the book-box is in the closed position, the salient portion of the male component is inserted in the aperture of the female component to maintain the book in the closed position. Thus, the presence of the salient part of the male component within said aperture restricts the degree of freedom of the articulation of the two symmetrical parts of the female component. The female component is thus maintained in the closed position.

SUMMARY OF THE INVENTION

It suffices to disengage the salient part of the male component from the aperture located within the female component to permit the articulation of the two symmetrical parts of the female component and thus the opening of the box.

In view of the above, the means for closing the box which is constituted by the male component of the book-box presents an attractive and original aspect insofar as it harmonizes with the rest of the structure in the combination.

According to a particularly advantageous characteristic of the invention, the sliding movements of the salient portion of the male component in the interior of the aperture of the female component are facilitated by a means of guiding constituted by guides and grooves cooperating with one another. These guides and grooves are preformed facing each other on the two lateral external faces of the salient portion of the male component and on the two lateral internal faces of the female component.

Preferably, and for practical technical reasons having to do with the manufacture of the parts, the guides are preformed on the two lateral external faces of the salient part of the male component and the two grooves are arranged on the two lateral internal faces of the female component. The engagement of the guides in the grooves facilitates the sliding of the salient portion of the male component into the interior of the female component assuring a greater reliability of the means for closing the book in the closed position.

According to another particularly advantageous characteristic of the invention, the salient part of the male component of the book-box intended for insertion into the female component is hollow to permit the storage of the pieces of a game.

A more complete appreciation of the invention and many of the attendant advantages thereof will be readily perceived as the same becomes better understood by reference to the following detailed description when considered in connection with the accompanying figures.

Other objects, advantages and features of the present invention will become apparent to those skilled in the art from the following discussion.

DESCRIPTION OF THE PREFERRED EMBODIMENTS

Figure 1:
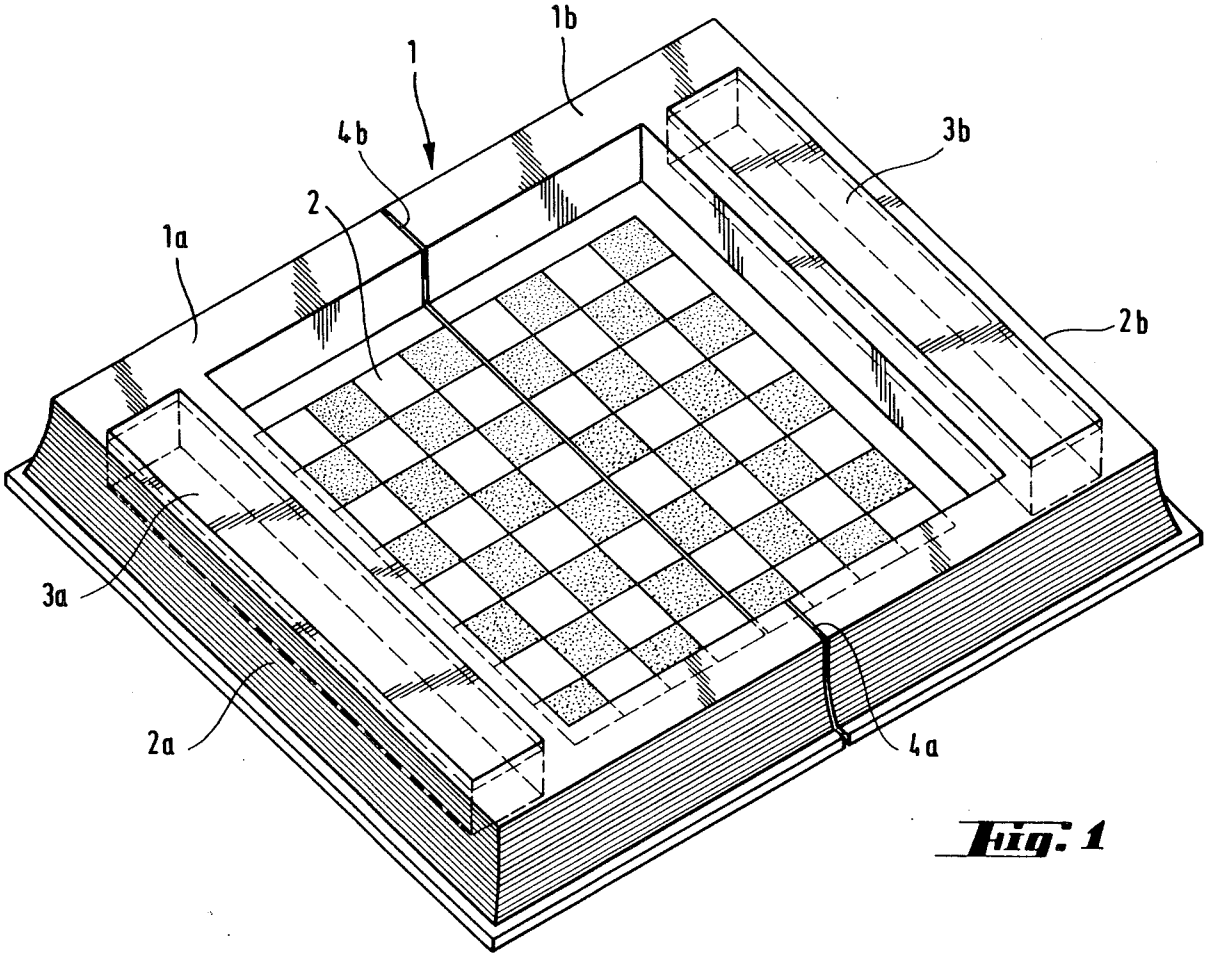
FIG. 1 is a perspective view of a book-box represented in the open position or playing position.

The box 1 represented in the open position in the drawing of FIG. 1 is constituted by two symmetrical parts 1*a* and 1*b* disposed one as a prolongation of the other and in the same plane. These two parts 1*a* and 1*b* define on their adjacent interior faces a gameboard 2 forming a surface of a checkers game or a chess game.

This game surface 2 is surrounded over the two exterior edges of the two symmetrical parts 1*a* and 1*b* by elevated encasings 2*a* and 2*b*, which are each one closed by a plane respectively referenced as 3*a* and 3*b* slidingly mounted above said encasement.

The encasement 2*a* and 2*b* permits the storage of game pieces such as the pawns for a checker game.

Figures 2, 3, 4:
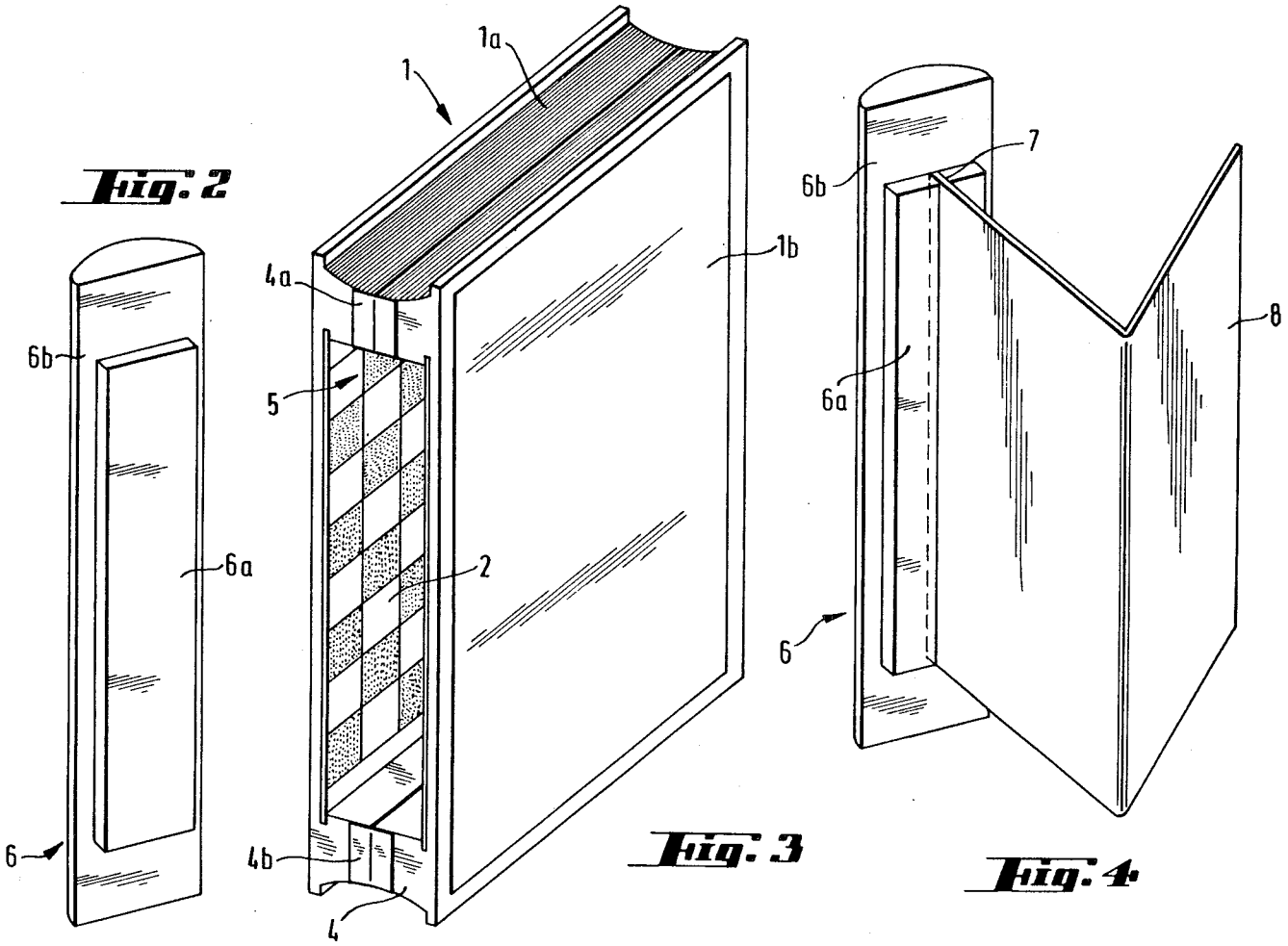
FIGS. 2 and 3 are perspective views of the two separate elements of the book-box according to one of the embodiments illustrated in the closed position or storage position.
FIG. 4 is a perspective view of a variation added to the component of FIG. 2.

In the closed position, such as that illustrated in the drawing of FIG. 3, the two symmetrical parts 1*a* and 1*b* articulated on one side by the articulation 4 by means of two hinges 4*a* and 4*b* can be closed one against the other and the two encasements 2*a* and 2*b* placed one next to the other.

According to one of the principal characteristics of the invention, the two symmetrical parts 1*a* and 1*b* form on the side of the articulation 4 in the closed position of the box 1 a rectangular aperture 5. The salient portion 6*a* of a male component 6 can then be appropriately inserted into said aperture 5.

The introduction of the salient portion 6*a* of the male component 6 into the aperture 5 of the female component has as its object maintaining the two symmetrical parts 1*a* and 1*b* of the female component at close range from one another and consequently locked in this position.

It suffices now to excise the salient portion of the male component 6*a* from its position inside the female component to permit the free articulation of the two symmetrical parts 1*a* and 1*b* of the female component on the side 4.

Advantageously, the two hinges 4*a* and 4*b* or other equivalent means for articulating the two parts of the female component are arranged on both sides of said aperture 5 so that they do not obstruct the passage of the salient portion 6*a* of the male component in and out of the aperture 5 such that they go unnoticed whether the book-box is in the closed or open positions.

In fact, when the box 1 is in the open position (FIG. 1), the hinges 4*a* and 4*b* can be seen in the reverse of the gameboard 2. When the box is in the closed position (FIGS. 2–3) the hinges are camouflaged by the edging 6*b* which forms the back of the male component 6 surrounding the salient part 6*a* of the male component and closes against the contour of the aperture 5 of the box 1 containing the two hinges 4*a* and 4*b*.

When the exterior faces of the edging 6*b* of the male component 6 and the two symmetrical parts 1*a* and 1*b* of the female component of the box 1 are covered with leather, the male and female components placed one inside of the other give the absolute appearance of being a book.

According to one embodiment of the invention such as that illustrated in FIG. 4 the interior of the salient portion 6*a* of the male component 6 of the book-box is provided with a longitudinal furrow 7 where the plane 8 is inserted. The plane 8 can be taken out of this position and positioned on the gameboard 2 formed by the two adjacent interior faces of the two symmetrical parts 1a and 1b of the female component in the open position (FIG. 1).

This game plane 8 is asymmetrically pliable over itself for easy insertion into the interior of the box 1 while the latter is in the closed position. The game plane 8 affords multiple game possibilities for said box.

According to another embodiment of the invention, the salient portion 6*a* of the male component 6 is hollow. Having a hollow male component permits the storage of other more bulky game pieces (card games, checkers, pawns and the like).

Figures 5, 6:
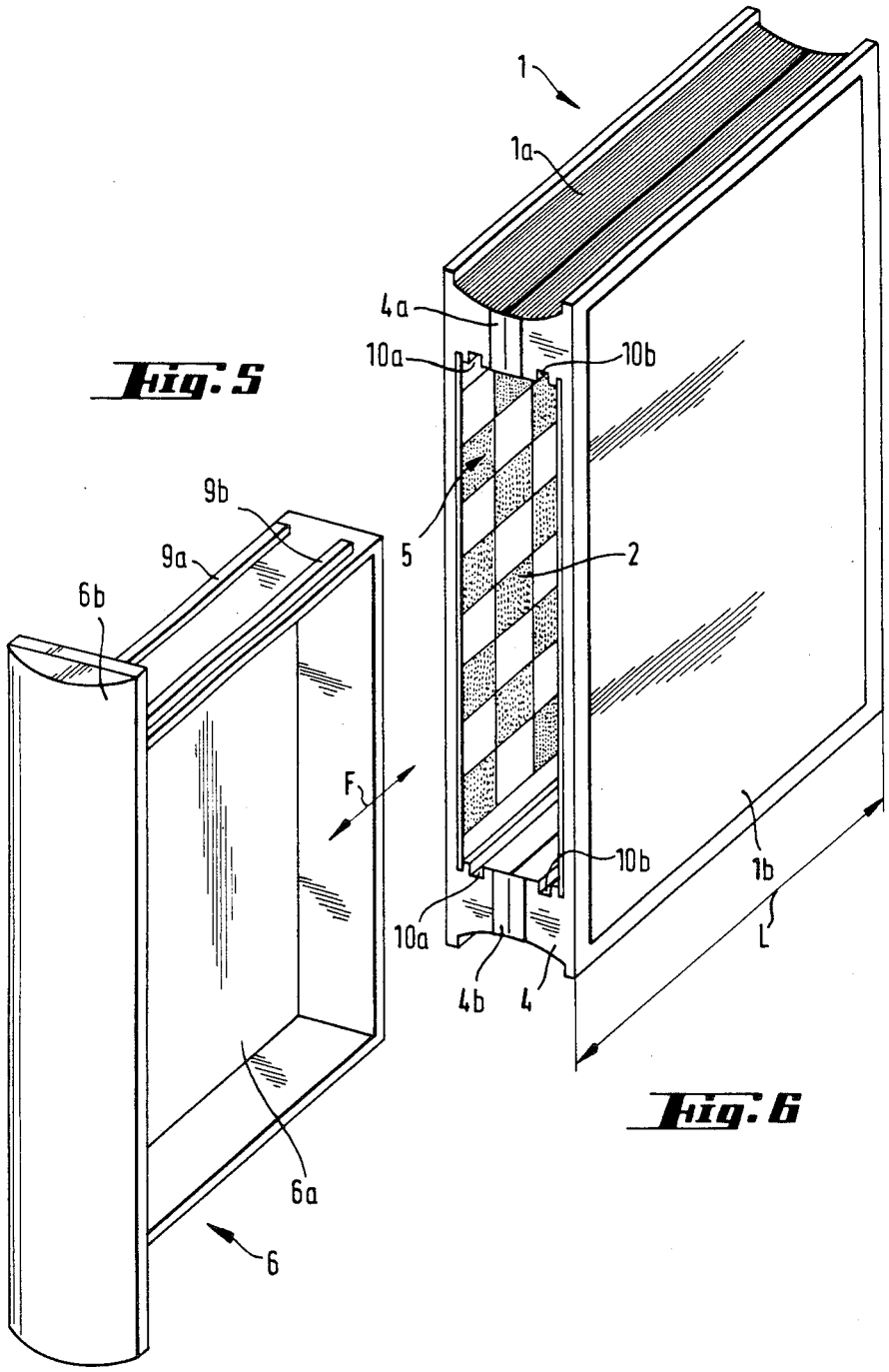
FIGS. 5 and 6 are perspective views of the two separate components of the book-box according to another embodiment of the invention illustrated in the closed position or storage position.

Since the salient portion 6*a* of the male component is very large, as illustrated in FIG. 5, it may otherwise receive other more voluminous objects than game pieces. In particular, if the box is utilized as a present it may be stuffed with gems, bottles, video and stereophonic cassettes, and the like.

According to a preferred embodiment of the invention, the translational movements (arrow F) of the salient portion 6*a* of the male component in the interior of the aperture 5 of the female component of the box 1 are assured by a guiding mechanism.

As can be seen in detail in the drawings of FIGS. 5 and 6, the means for guiding is constituted by an ensemble of two pairs of guides 9*a* and 9*b* positioned in the male component cooperating with two pairs of grooves positioned in the female component 10*a* and 10*b* at the time of the insertion of the salient portion 6*a* of the male component into the aperture 5 of the female component provided on the side of the articulation 4 of the boook-box 1.

The two pairs of guides 9*a* and 9*b* of the male component are preformed onto each one of the two external lateral faces of the salient portion 6*a* of the male component and the two pairs of grooves 10*a* and 10*b* are provided on the two internal lateral faces of the two parts of the female component of box 1.

The two grooves of each pair are arranged on each one of the two symmetrical parts 1*a* and 1*b* of the female component. The two pairs of guides and the two pairs of grooves designed to cooperate with one another assure a better guidance of the salient portion 6*a* of the male component 6 into the aperture 5 of the female component of the box 1. The two corresponding pairs of guides and grooves also permit a better locking of the box in the closed position.

In fact, when the box 1 is in the closed position the salient portion 6*a* of the male component can be introduced into the interior of the female component. When this occurs, the presence of the guides 9*a* and 9*b* engaged in the interior of the grooves 10*a* and 10*b* over the whole length of the latter corresponding to the length L of the box 1 limit the degree of freedom of the angle of aperture formed between the two symmetrical parts 1*a* and 1*b* of the female component over the entire length L of said box.

In effect, the more distant the point of blockage of the articulated parts 1*a* and 1*b* is from the point of articulation, the lesser the degree of freedom between the two symmetrical parts 1*a* and 1*b*.

A description and representation of the invention incorporated herein above should be regarded as a general description and not as a limitation of the scope thereof.

In order to permit a better comprehension of the drawings, a list of numeral references with the corresponding legends are listed hereinbelow.

1 Box or female component
1*a* and 1*b* Articulated symmetrical parts of the box 1
2 Game surface
2*a* and 2*b* Elevated encasements
3*a* and 3*b* Planes slidingly closing the elevated encasings
4 Articulation side of the symmetrical parts 1*a* and 1*b*
4*a* and 4*b* Two hinges
5 Aperture
6 The male component of the book-box.
6*a* Salient part of the male component 6.
6*b* Back of the book bordering the salient part 6*a*.
7 Longitudinal furrow
8 Gameboard
9*a* and 9*b* Guides of the guiding mechanism.
10 and 10*b* Grooves of the guiding mechanism

I claim:

1. In a box for storing social games, said box having the form of a book and comprising two symmetrical parts forming the covers of the book which are articulatedly mounted on one another, said box being movable between a closed position and an open position, said symmetrical parts being positioned one adjacent the other on one plane onto which game pieces can be placed when the box is in the open position and each said symmetrical part being pressed against the other when the box is in the closed position, the improvement wherein:

said box further comprises a male component forming the back of the book and having a salient portion;

the two symmetrical parts forming the covers of the book form a female component of the box which is further provided with an aperture where the salient portion can be inserted to secure the box in the closed position, said aperture being provided on the side of the female component where the symmetrical parts are articulatedly mounted on one another;

said box further comprises a gameboard which is asymmetrically pliable onto itself and when fully open can be positioned on the two symmetrical parts when said box is in the open position; and said salient portion has an internal face which is provided with a longitudinal groove for insertion of said gameboard.

2. The box of claim 1 wherein the two book covers and the back of the book are further covered with leather.

3. The box of claim 1 wherein the two symmetrical parts of the female component are articulatedly mounted onto one another by means of at least two hinges; and the hinges are externally attached to the two symmetrical parts of said female component on both sides of the aperture.

4. The box of claim 3 wherein the back of the book has a width and a length in excess of the salient portion and lies opposite the symmetrical parts of said female component in the area where the hinges are attached thereto and adjacent the aperture when the book is in the closed position.

5. The box of claim 1 wherein the back of the book has a width and a length in excess of the salient portion such that the salient portion is surrounded by parts of the back.

6. In a box for storing social games, said box having the form of a book and comprising two symmetrical parts forming the covers of the book which are articulatedly mounted on one another, said box being movable between a closed position and an open position, said symmetrical parts being positioned one adjacent the other on one plane onto which game pieces can be placed when the box is in the open position and each said symmetrical part being pressed against the other when the box is in the closed position, the improvement wherein:

said box further comprises a male component forming the back of the book and having a salient portion;

the two symmetrical parts forming the covers of the book form a female component of the box which is further provided with an aperture where the salient portion can be inserted to secure the box in the closed position, said aperture being provided on the side of the female component where the symmetrical parts are articulatedly mounted on one another;

said box further comprises a top side and a bottom side;

said male component further comprises a pair of side panels attached to said salient portion, each male side panel having an external face and at least one guide provided on said external face and positioned along the length of said male side panel;

said female component further comprises at least one pair of side panels, each said female side panel being attached to a symmetrical part along the length of the top and bottom sides of the book, each said female side panel having an internal face and at least one groove provided on said internal face and positioned along said female side panel; and each said male side panel has two preformed guides and each said female side panel has two preformed grooves, and each said guide and a corresponding groove slidingly engage one another when the male component is inserted into the female component of the block.

7. The box of claim 6 wherein said male component is hollow to permit the storage of game pieces.

8. The box of claim 6 wherein the two book covers and the back of the book are further covered with leather.

9. The box of claim 6 wherein the two symmetrical parts of the female component are articulatedly mounted onto one another by means of at least two hinges; and the hinges are externally attached to the two symmetrical parts of said female component on both sides of the aperture.

10. The box of claim 9 wherein the back of the book has a width and a length in excess of the salient portion and lies opposite the symmetrical parts of said female component in the area where the hinges are attached thereto and adjacent the aperture when the book is in the closed position.

11. The box of claim 6 wherein the back of the book has a width and a length in excess of the salient portion such that the salient portion is surrounded by parts of the back.

12. In a box for storing social games, said box having the form of a book and comprising two symmetrical parts forming the covers of the book which are articulatedly mounted on one another, said box being movable between a closed position and an open position, said symmetrical parts being positioned one adjacent the other on one plane onto which game pieces can be placed when the box is in the open position and each said symmetrical part being pressed against the other when the box is in the closed position, the improvement wherein:

said box further comprises a male component forming the back of the book and having a salient portion;

the two symmetrical parts forming the covers of the book form a female component of the box which is further provided with an aperture where the salient portion can be inserted to secure the box in the closed position, said aperture being provided on the side of the female component where the symmetrical parts are articulatedly mounted on one another;

said box further comprises a top side and a bottom side;

said male component further comprises a pair of side panels attached to said salient portion, each male side panel having an external face and at least one guide provided on said external face and positioned along the length of said male side panel;

said female component further comprises at least one pair of side panels, each said female side panel being attached to a symmetrical part along the length of the top and bottom sides of the book, each said female side panel having an internal face and at least one groove provided on said internal face and positioned along said female side panel;

each said guide and a corresponding groove slidingly engage one another when the male component is inserted into the female component of the book;

said female component has two pairs of side panels, one side panel of each pair is attached to the top side and the other side panel of the same pair is attached to the bottom side of each said symmetrical part of said female component, and each said female side panel is provided with one groove; and each said two female side panels located on the same end of the symmetrical parts are superimposed onto one another when the box is in the closed position and are positioned longitudinally, one at the end of the other when the box is in the open position.

13. The box of claim 12 wherein said male component is hollow to permit the storage of game pieces.

14. The box of claim 12 wherein the two book covers and the back of the book are further covered with leather.

15. The box of claim 12 wherein the two symmetrical parts of the female component are articulatedly mounted onto one another by means of at least two hinges; and the hinges are externally attached to the two symmetrical parts of said female component on both sides of the aperture.

16. The box of claim 15 wherein the back of the book has a width and a length in excess of the salient portion and lies opposite the symmetrical parts of said female component in the area where the hinges are attached thereto and adjacent the aperture when the book is in the closed position.

17. The box in claim 12 wherein the back of the book has a width and a length in excess of the salient portion such that the salient portion is surrounded by parts of the back.

* * * * *